US005997693A

United States Patent [19]

Hirooka et al.

[11] Patent Number: 5,997,693

[45] Date of Patent: Dec. 7, 1999

[54] STOCK LIQUOR PRESSURE PULSATION ABSORBING APPARATUS AND METHOD

[75] Inventors: Hideki Hirooka; Toshimi Tajima; Tetsuo Makino, all of Hiroshima; Mamoru Tanaka, Takasago, all of Japan

[73] Assignee: Mitsubishi Heavy Industries, Ltd., Tokyo, Japan

[21] Appl. No.: 09/096,384

[22] Filed: Jun. 12, 1998

[30] Foreign Application Priority Data

Jun. 30, 1997 [JP] Japan ..... 9-174095

[51] Int. Cl.[6] ..... D21F 1/00

[52] U.S. Cl. ..... 162/336; 137/115.16; 137/115.25; 137/565.34; 162/380; 417/44.2

[58] Field of Search ..... 162/380, 336; 137/565.34, 115.25, 115.16; 417/44.2

[56] References Cited

U.S. PATENT DOCUMENTS

| | | | |
|---|---|---|---|
| 4,308,095 | 12/1981 | Brendemuechl | 162/380 |
| 4,384,922 | 5/1983 | Stotz | 162/336 |

FOREIGN PATENT DOCUMENTS

| | | |
|---|---|---|
| 0 335 343 | 10/1989 | European Pat. Off. . |
| 55-103388 | 8/1980 | Japan . |
| 1-298291 | 12/1989 | Japan . |
| 4-33695 | 3/1992 | Japan . |

*Primary Examiner*—Peter Chin
*Attorney, Agent, or Firm*—Wenderoth, Lind & Ponack, L.L.P.

[57] ABSTRACT

A stock liquor pressure pulsation absorbing apparatus of an active type is able to absorb pressure pulsations in an ordinarily demanded frequency range of 0.01 to 100 Hz. A by-pass pipe (2) extracts a portion of a stock liquor from a master pipe (1) for supplying the stock liquor to a paper machine headbox. A control pump (7) returns a portion of the stock liquor so extracted into the by-pass pipe. A detector (3) detects a stock liquor pulsation pressure at a branch point, or on an upstream side thereof, of the by-pass pipe and master pipe for controlling the control pump. The pressure pulsation, including the low frequency range, of the stock liquor is thereby absorbed accurately and precisely, variations in the basis weight are made small and a stable supply of final products with a high quality can be attained.

11 Claims, 7 Drawing Sheets

STOCK LIQUOR PRESSURE PULSATION ABSORBING APPARATUS AND METHOD

BACKGROUND OF THE INVENTION

1. Field of the Invention

The present invention relates to a stock liquor pressure pulsation absorbing apparatus and method for carrying out an active absorption of low frequency pressure pulsation in a stock liquor piping system.

2. Description of the Prior Art

Prior art of the above-mentioned type will be described with reference to FIGS. 8 and 9.

FIG. 8 shows schematically a stock liquor flow passing through an attenuator, which is widely used in the prior art. Stock liquor is fed into a master pipe 03 by a fan pump 01 via a screen 02 to flow through an attenuator 04, which is disposed midway along the master pipe 03. The stock liquor enters a headbox 08, is then injected onto a wire 09 to enter a paper forming process, and is formed into paper via a downstream dewatering process and drying process which are not shown.

The attenuator 04 consists of a portion of the master pipe 03, an air chamber 05 which is partitioned from the master pipe 03 by a diaphragm 06, etc. The air chamber 05 communicates with a volume tank through a passage 07, so that pressure in the air chamber 05 is set to be equal to a mean pressure in the master pipe 03 by a controller which is not shown.

Thus, when a pulsation occurs which is higher than the mean pressure in the master pipe 03, the pressure in the master pipe 03 becomes higher than the pressure in the air chamber 05, and the diaphragm 06 is pressed down. As a result, the stock liquor, in an amount corresponding to the volume increase in the master pipe 03 due to displacement of the diaphragm 06, is absorbed, and flow variation in the master pipe 03 of the stock liquor flowing into the headbox 08 is mitigated.

When a pulsation occurs which is lower than the mean pressure in the master pipe, the diaphragm 06 is pushed up and the pulsation is absorbed. That is, the attenuator in the prior art is a pressure pulsation absorbing apparatus of a passive type in which the pulsation is absorbed by a differential pressure between the pressure in the master pipe 03 and the internal pressure of the air chamber 05.

Also, Japanese laid-open patent application No. Hei 1(1989)-298291 discloses an apparatus in which water is supplied into stock liquor piping. The flow rate of the water is controlled, whereby pulsation in the stock liquor piping is absorbed.

An outline of this apparatus is shown in FIG. 9, wherein a pressure gauge 016 is disposed downstream of a joining point of stock liquor piping 015 and a water supply pipe 014. A valve 011 is opened and closed by a pressure signal taken from the pressure gauge 016, and thus the flow rate of the water flowing into the stock liquor piping 015 from the water supply pipe 014 is controlled. It is mentioned there that a pulsation of 1 to 50 Hz can be absorbed by this apparatus.

In this apparatus, however, if a low frequency pulsation of 1 Hz or less is to be absorbed, it is necessary to supply a large amount of water, and a possibility occurs of causing a consistency variation of the stock liquor in the piping. It can be said, therefore, that absorption of the low frequency pulsation will be very difficult.

It is to be noted in FIG. 9 that numeral 012 designates a controlling member for operating the valve 011, numeral 013 designates a servo valve, numeral 017 designates an electronic regulator for transmitting a command of the pressure gauge 016, numeral 018 designates a water tank, numeral 019 designates an operating oil tank and numeral 020 designates a headbox.

Generally, in order to obtain a very stable operation of a paper machine, it is necessary to make a pressure pulsation level within ±0.5 to ±1% or less of a mean pressure in a range of 0.01 to 100 Hz. In an ordinary paper making plant, however, such a severe permissible pressure pulsation level will hardly be secured even if the design of the piping systems therefor is done with full deliberation.

As the frequency of pressure pulsation becomes lower, flow variation becomes larger, generally, and the stock liquor absorption amount at the attenuator increases. Because the attenuator is of a structure to absorb variation in the flow rate of the stock liquor using a diaphragm, in order to absorb a pulsation of low frequency, especially of 1 Hz or less, it is necessary to enlarge an area and displacement amount of the diaphragm. However, there are restrictions from the structure, installation space, etc., and hence a pulsation absorption performance at 1 Hz or less has been inevitably lowered. Moreover, pulsation absorption of 1 Hz or less has been very difficult not only simply due to this facilities-related reason, but from a functional point of view also.

The above problems are applicable to the apparatuses shown in FIGS. 8 and 9 generally, and as to the apparatus shown in FIG. 9 also, there are considered additional problems in securing water to be supplied for the controlling, handling and treating of the water, controlling the stock liquor consistency after water is added, etc., and an actual apparatus will be hardly realized.

SUMMARY OF THE INVENTION

In view of such technological needs and problems in the prior art as mentioned above, it is an object of the present invention to provide a stock liquor pressure pulsation absorbing apparatus and method of an active type which is able to detect a pulsation pressure of stock liquor and to securely control it corresponding thereto even in a low frequency range.

In order to attain the object, the present invention provides a stock liquor pressure pulsation absorbing apparatus comprising a by-pass pipe for extracting a portion of a stock liquor from a master pipe for supplying the stock liquor to a paper machine headbox. A control pump returns a portion of the stock liquor so-extracted into the by-pass pipe. A detector detects a stock liquor pulsation pressure at a branch point, or on an upstream side thereof, of the by-pass pipe and master pipe for controlling the control pump.

That is, in the present invention, a portion of the stock liquor is made extractable from the master pipe via the by-pass pipe and the stock liquor pulsation pressure in the master pipe is detected at the branch point from which the extraction is done or on the upstream side thereof. The control pump for the by-pass pipe is thereby controlled and the amount of the stock liquor extracted into the by-pass pipe is regulated. Accordingly, the pressure pulsation of the stock liquor is absorbed accurately and precisely, and especially pressure pulsation in a low frequency range can be greatly reduced.

Also, the present invention provides a stock liquor pressure pulsation absorbing apparatus comprising a by-pass pipe for extracting a portion of a stock liquor from a master pipe for supplying the stock liquor to a paper machine headbox. A control valve controls an extraction amount of the stock liquor midway of the by-pass pipe. A means detects a stock liquor pulsation pressure at a branch point, or on an upstream side thereof, of the by-pass pipe and master pipe for controlling the control valve.

That is, in the present invention, a portion of the stock liquor is made extractable from the master pipe via the by-pass pipe and the stock liquor pulsation pressure in the master pipe is detected at the branch point from which the extraction is done or upstream thereof. Opening of the control valve disposed midway of the by-pass pipe is thereby controlled and the amount of the stock liquor extracted into the by-pass pipe is regulated. Thus the pressure pulsation of the stock liquor is absorbed accurately and precisely, and especially pressure pulsation in the low frequency range can be reduced greatly.

Also, the present invention provides a stock liquor pressure pulsation absorbing apparatus as set forth above, characterized in that a diaphragm type attenuator is provided on the upstream side or a downstream side of the branch point of the by-pass pipe and master pipe.

That is, in the present invention, the pressure pulsation in the low frequency range depends on the control by use of the by-pass pipe and the pressure pulsation in the higher frequency range is absorbed by the ordinary diaphragm type attenuator. By such division of function, respective advantageous functions are combined so as to attain a high efficiency of pressure pulsation absorption, and compact sized facilities can be realized after all.

Further, the present invention provides a stock liquor pressure pulsation absorbing method comprising extracting a portion of a stock liquor continuously from a master pipe for supplying the stock liquor to a paper machine headbox, and increasing or decreasing an amount of the stock liquor to be so extracted corresponding to a size of pulsation pressure in the master pipe.

That is, in the present invention, in addition to the piping of the master pipe for supplying the stock liquor to the paper machine headbox, piping for continuously extracting a portion of the stock liquor is provided. The amount of the stock liquor to be extracted is increased or decreased corresponding to the size of the pulsation pressure in the master pipe. The pulsation of the stock liquor is thereby absorbed accurately and precisely, and variation in the basis weight becomes small, which results in a stable supply of final products of a high quality.

DESCRIPTION OF THE PREFERRED EMBODIMENTS

Figure 1:
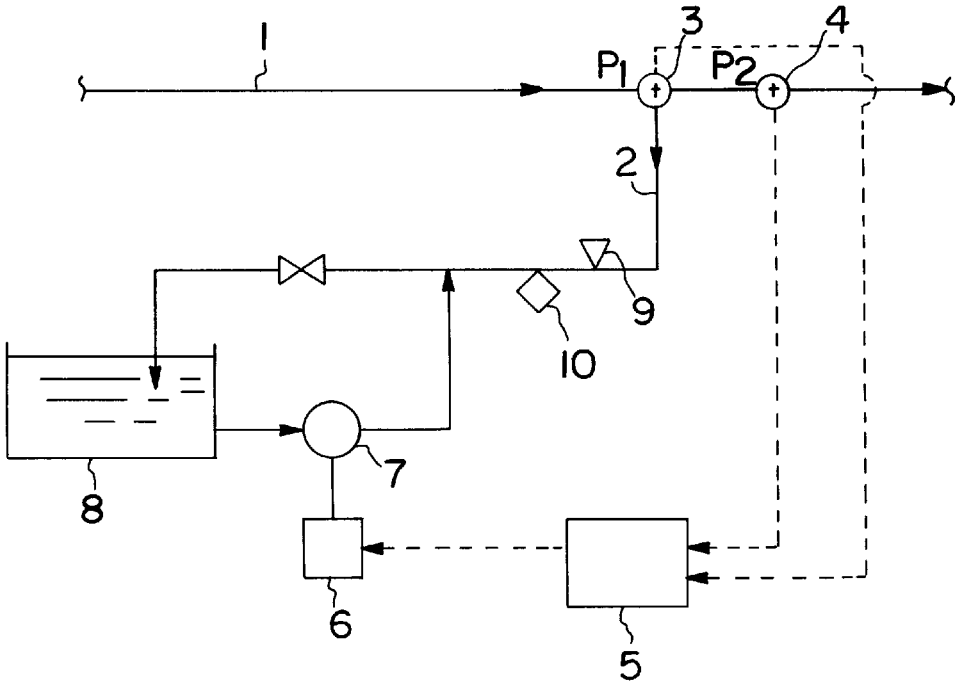
FIG. 1 is an explanatory view of a stock liquor pressure pulsation absorbing apparatus (attenuator) using a by-pass pipe and a variable speed pump of a first embodiment according to the present invention.

A stock liquor pressure pulsation absorbing apparatus (attenuator) of a first embodiment according to the present invention will be described with reference to FIG. 1.

A small diameter by-pass pipe 2 is provided branching from a master pipe 1 which supplies stock liquor to a paper machine headbox (not shown), so that a substantially constant amount of the stock liquor may be extracted continuously into a by-pass tank 8 with an opening of a valve being set. Also, a portion of the stock liquor is extracted from the by-pass tank 8 by a control pump 7 so as to be circulated to an upstream side of the valve disposed in the by-pass pipe 2. The flow rate in the by-pass pipe 2 is thereby regulated, and thus the extraction rate from the master pipe 1 is regulated.

Figure 10:
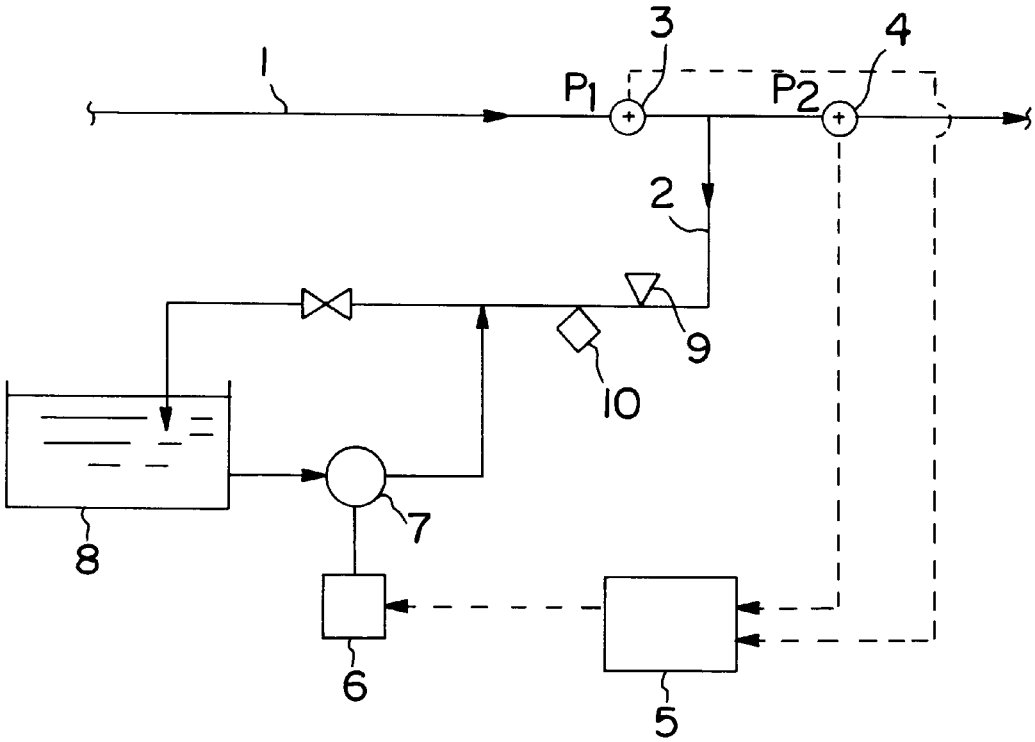
FIG. 10 is an explanatory view showing a variation of the first embodiment of FIG. 1.

The control pump 7 is controlled via a controller 5 and an inverter 6 by a signal of pulsation pressure $P_1$ detected by a pressure gauge 3 at a branch point of the master pipe 1 and the by-pass pipe 2. The pulsation pressure $P_1$ may be detected alternatively by a pressure gauge 3 disposed on an upstream side of the branch point, as shown in FIG. 10.

That is, a signal of reverse phase is given to the control pump 7 corresponding to pulsation of the pulsation pressure $P_1$ so detected and, if the pulsation pressure $P_1$ becomes larger, rotation of the control pump 7 is reduced so that the liquor supply amount therefrom into the by-pass pipe 2 is reduced, which results in increase in amount of the stock liquor flowing into the by-pass pipe 2 from the master pipe 1. The pulsation in the master pipe 1 is thus absorbed.

In case the pulsation pressure $P_1$ becomes smaller, a reverse operation to that mentioned above is carried out so as to absorb the pulsation. It is to be noted that pulsation pressure $P_2$ detected by a pressure gauge 4 disposed on a downstream side of the pressure gauge 3 is what is called a value after control, which can be used as a monitor, or a signal for controlling the pulsation pressure $P_2$ so that it approaches toward zero variation. Also, in FIG. 1, numeral 9 designates a flow meter and numeral 10 designates a Pitot tube. Furthermore, a surplus amount of the stock liquor beyond a predetermined amount in the by-pass tank 8 is returned to a stock liquor supply source (not shown) via a return passage (not shown).

Figure 4:
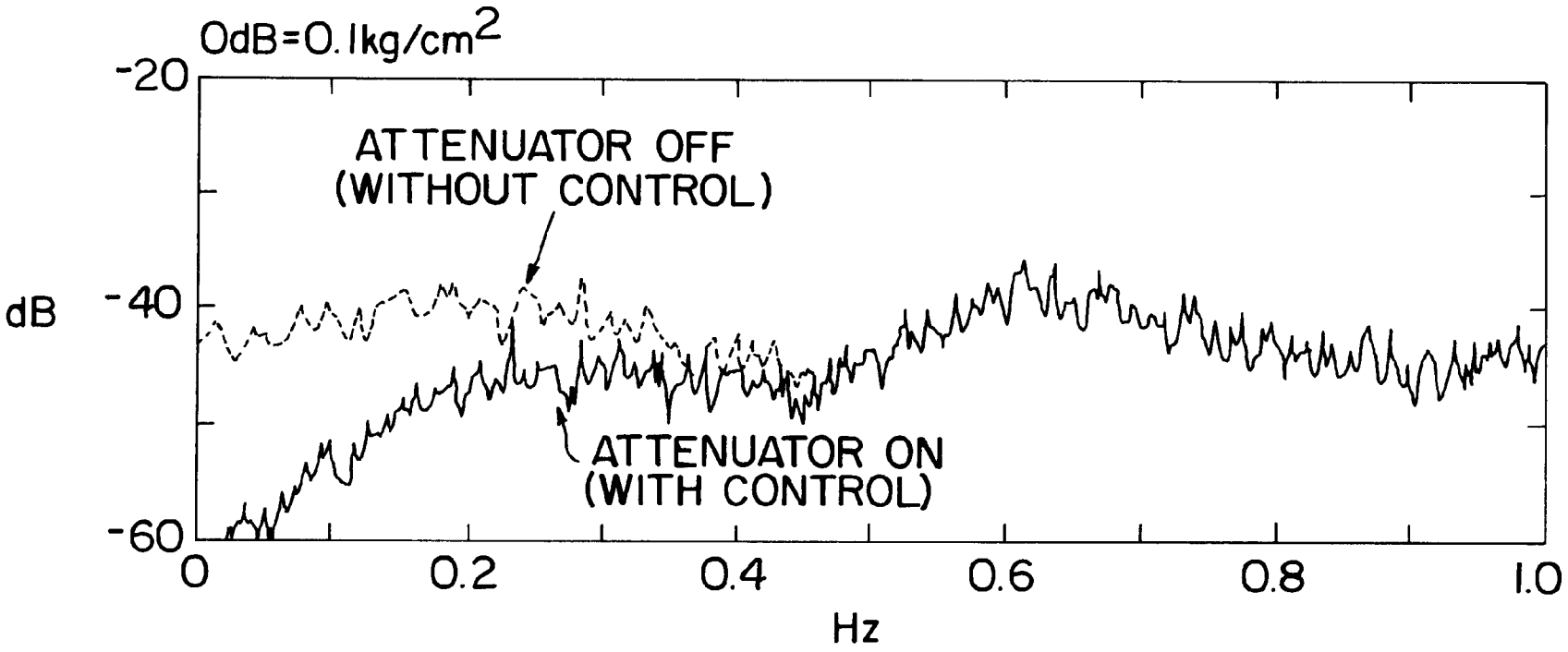
FIG. 4 is an explanatory view showing experimental result of the first embodiment of FIG. 1.

Experimental results in which the pulsation in the master pipe 1 has been absorbed by use of the first embodiment are shown in FIG. 4. The horizontal axis thereof shows the frequency of the pulsation in the master pipe 1 and the vertical axis thereof shows the pulsation pressure in the master pipe 1. Also, broken lines drawn in an upper part thereof show pressure in the case of "without control" and solid lines in a lower part thereof show pressure in the case of "with control". It has been confirmed from this figure that the pulsation in the low frequency range of 0.5 Hz or less can be absorbed by the system using the control pump 7 of a variable speed type.

Figure 2:
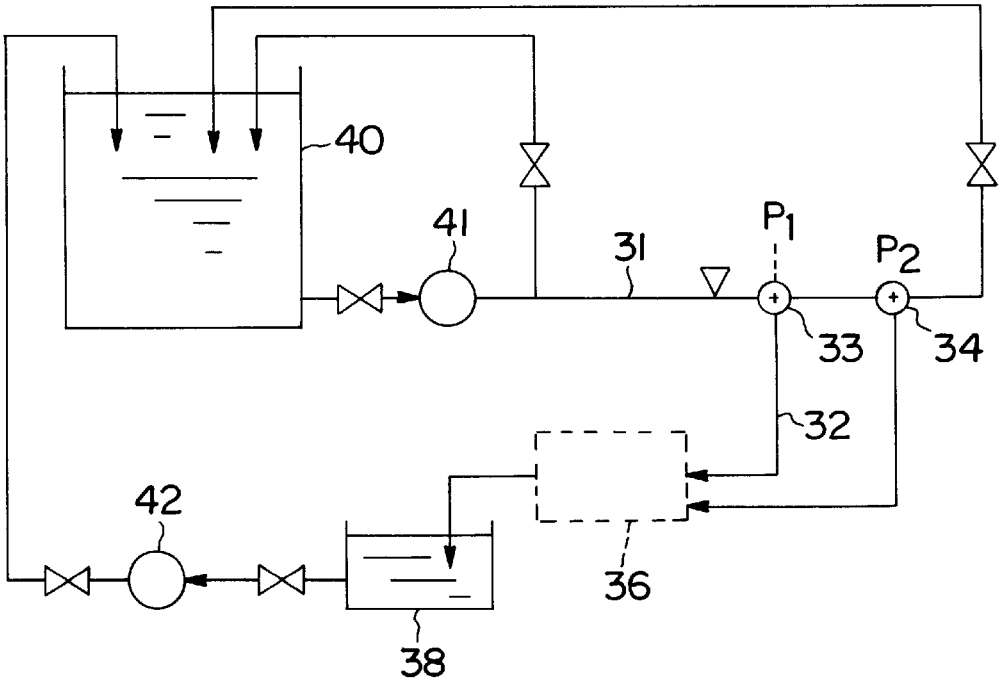
FIG. 2 is an explanatory view of an example of a piping system constructed experimentally according to the first embodiment of FIG. 1.

Further, an example of a piping system constructed experimentally according to the first embodiment in which the flow rate in the by-pass pipe is pump-controlled will be described with reference to FIG. 2. In this example, stock liquor of consistency of 1% is supplied from a tank 40 by a circulating pump 41 into a master pipe 31 which is of a size of 150 A ("A" is a designation of piping and "150 A" means a pipe of inner diameter which is very near to 150 mmϕ). A by-pass pipe 32 of a size of 40 A is provided midway of the master pipe 31 so that a portion of the stock liquor in the master pipe 31 flows continuously into the by-pass pipe 32.

The flow rate in the master pipe 31 is set to 3 $m^3$/min and the flaw rate in the by-pass pipe 32 is changed in the range of 0.05 to 0.15 $m^3$/min. Pressure $P_1$ before the by-pass pipe 32 (pressure before control) and pressure $P_2$ after the by-pass pipe 32 (pressure after control) are detected by a pressure gauge 33 and 34, respectively, and a pressure signal in the master pipe 31 is picked up by use of the pressures $P_1$ and $P_2$. Thus, corresponding to pulsation thereof, a control unit 36 is actively operated, by which the flow rate in the by-pass pipe 32 is controlled so that pulsation in the master pipe 31 is absorbed.

It is to be noted that numeral 38 designates a tank which receives for a time the stock liquor flowing in the by-pass pipe 32 and numeral 42 designates a return pump for returning the stock liquor to the tank 40 from the tank 38.

Figure 3:
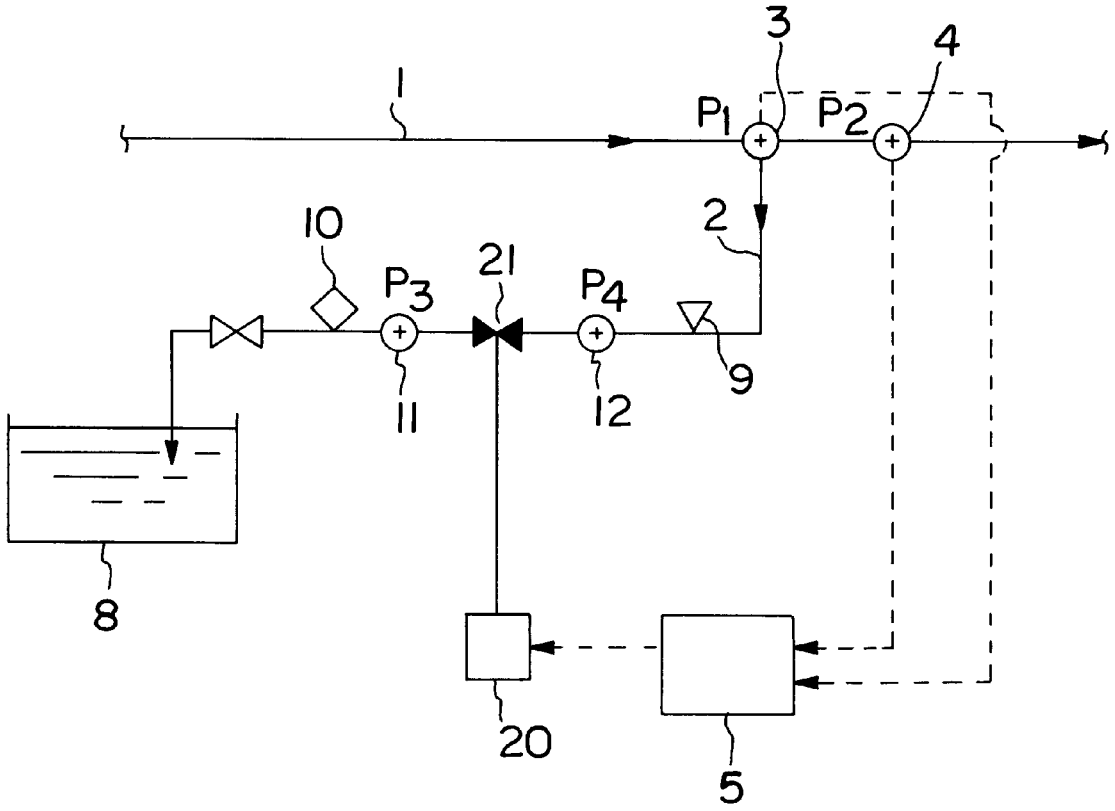
FIG. 3 is an explanatory view of a stock liquor pressure pulsation absorbing apparatus (attenuator) using a by-pass pipe and a control valve of a second embodiment according to the present invention.

Next, a stock liquor pressure pulsation absorbing apparatus (attenuator) of a second embodiment according to the present invention will be described with reference to FIG. 3. Here, the same parts as that shown with respect to the first embodiment are given same numeral in the figure, and repeated description is omitted.

Figure 11:
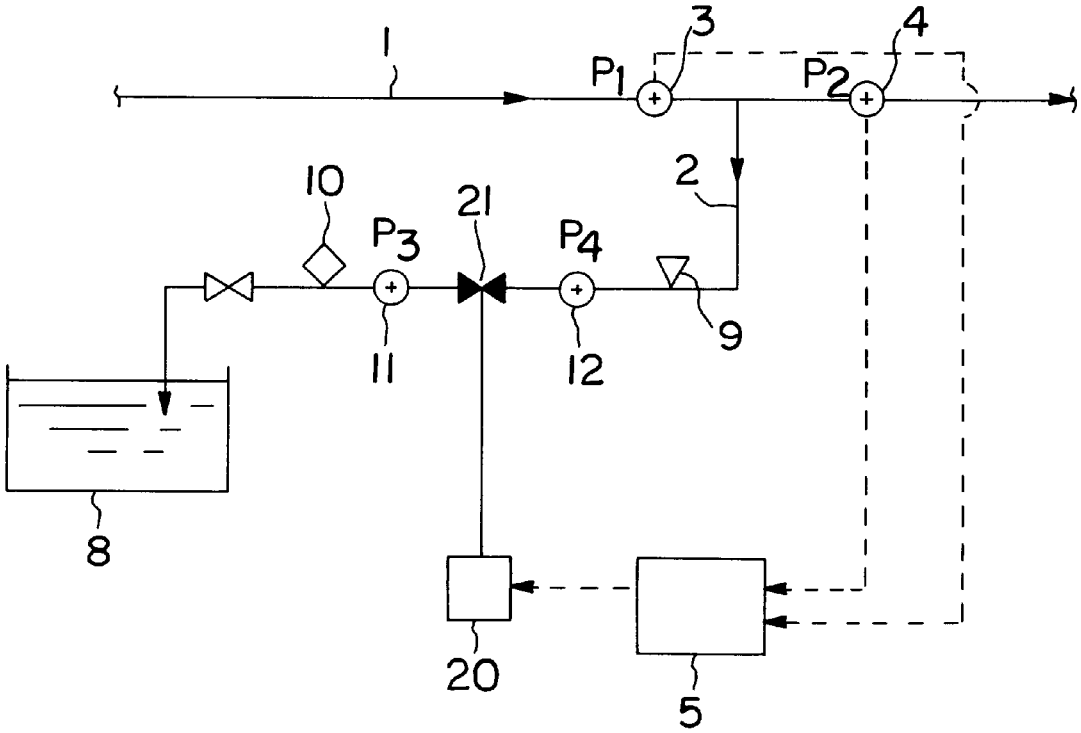
FIG. 11 is an explanatory view showing a variation of the second embodiment of FIG. 3.

A small diameter by-pass pipe 2 is provided branching from a master pipe 1 which supplies stock liquor to a paper machine headbox (not shown). There is provided in this by-pass pipe 2 a control valve 21 which is operated to open and close by an actuator 20 receiving signal of pulsation pressure $P_1$ detected by a pressure gauge 3. While the pulsation pressure $P_1$ is detected at a branch point of the master pipe 1 and the by-pass pipe 2, it may be detected alternatively by a pressure gauge 3 disposed on an upstream side of the branch point, as shown in FIG. 11.

Also, pulsation pressure $P_2$ detected by a pressure gauge 4 disposed on a downstream side of the pressure gauge 3 may be used as a monitor, or a signal for controlling the pulsation pressure $P_2$ so that it approaches toward zero variation. If pressure $P_3$ and $P_4$ detected by a pressure gauges 11 and 12, respectively, after and before the control valve 21 are made use of, a more precise control may be carried out as a whole. A surplus amount of the stock liquor, beyond a predetermined amount in the by-pass tank 8, is returned as in the first embodiment.

Figure 5:
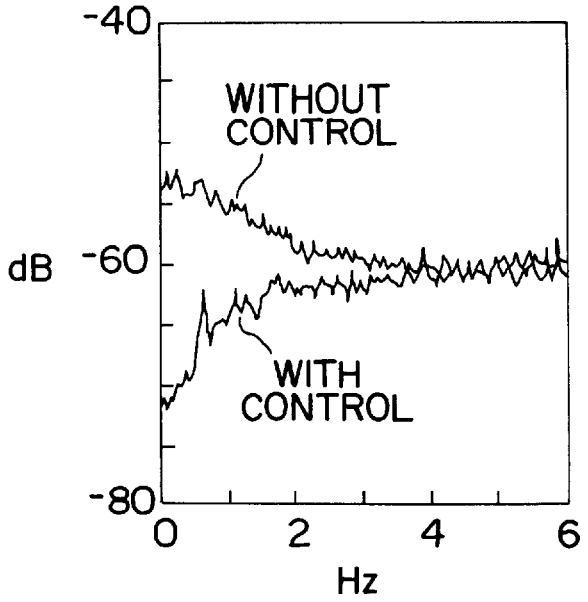
FIG. 5 is an explanatory view showing experimental results of the second embodiment of FIG. 3.

Experimental results of experiments in which the pulsation in the master pipe 1 has been absorbed by use of the second embodiment are shown in FIG. 5. The horizontal axis thereof shows the frequency of the pulsation in the master pipe 1 and the vertical axis thereof shows pulsation pressure in the master pipe 1 for comparison of the pulsation pressure in cases of "without control" and "with control". It has been confirmed from this figure that the pulsation in the low frequency range of 3 Hz or less can be absorbed by the system using the control valve 21 of a variable throttle type.

Next, a stock liquor pressure pulsation absorbing apparatus (attenuator) of a third embodiment according to the present invention will be described with reference to FIGS. 6 and 7. In the present embodiment, the above-described first embodiment or the second embodiment is combined with the prior art attenuator.

That is, the first embodiment or the second embodiment, both being especially effective for pulsation absorption in the low frequency range, is employed as a low frequency attenuator, and the prior art attenuator operated by a diaphragm is employed as a high frequency attenuator.

Figure 6:
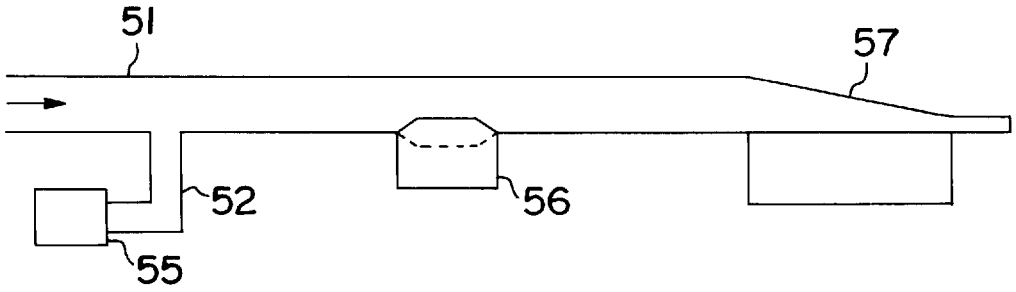
FIG. 6 is an explanatory view of a stock liquor pressure pulsation absorbing apparatus (attenuator) in which a low frequency attenuator and a high frequency attenuator are combined in a third embodiment according to the present invention.

FIG. 6 shows one example of the third embodiment, constructed such that a low frequency attenuator 55 having a by-pass pipe 52 is provided on an upstream side of a master pipe 51, which extends to a paper machine headbox 57, and a high frequency attenuator 56 is provided downstream thereof.

Figure 7:
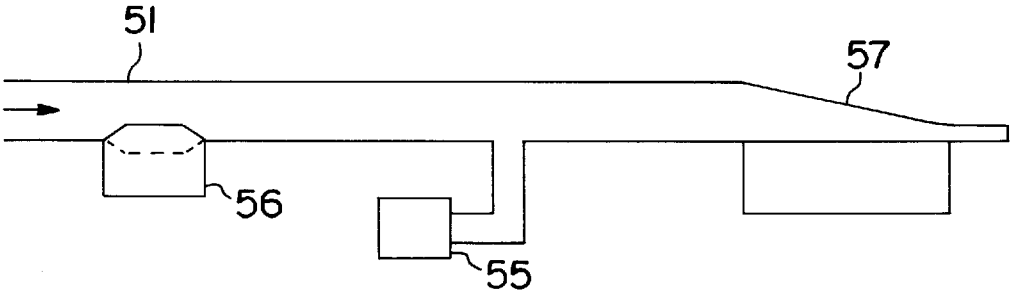
FIG. 7 is an explanatory view showing a variation of the third embodiment of FIG. 6.
Figure 8:
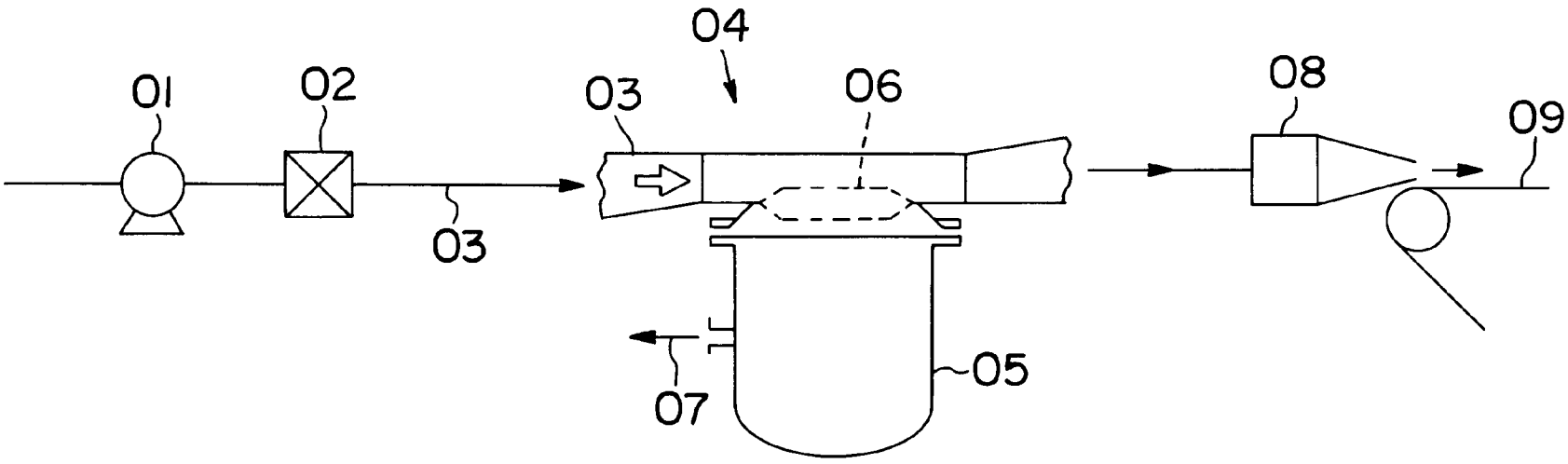
FIG. 8 PRIOR ART
FIG. 8 is an explanatory view showing an example in the prior art.
Figure 9:
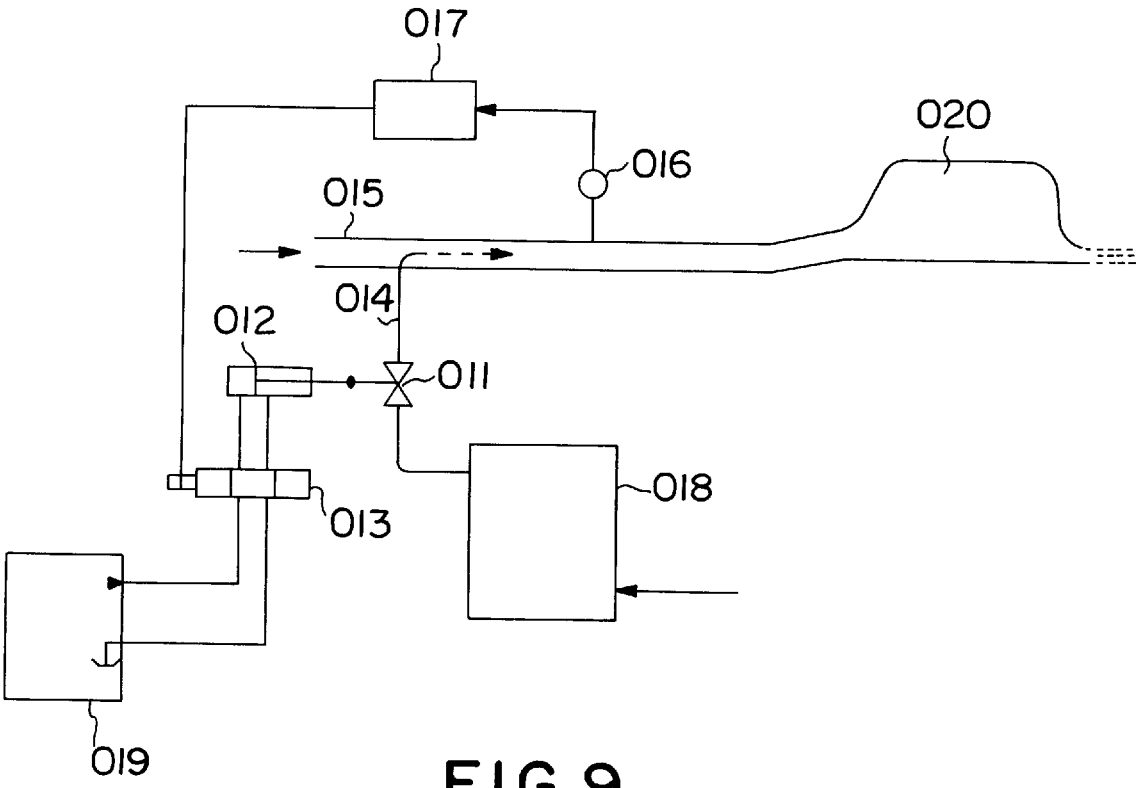
FIG. 9 PRIOR ART
FIG. 9 is an explanatory view showing another example in the prior art.

Also, FIG. 7 shows another example of the third embodiment, constructed such that the high frequency attenuator 56 is provided upstream and the low frequency attenuator 55 is provided downstream, reversely of the above example.

Because the pulsation frequency in question is approximately in the range of 0.01 to 100 Hz in an actual machine, the system of the present embodiment in which the low frequency attenuator 55 of an active type and the high frequency attenuator 55 of a passive type are combined in series is able to absorb well pulsation in the range of 0.01 to 100 Hz, which is the range demanded in an actual machine.

Also, by the use of such a combined system, the high frequency attenuator 56 may be relieved from functioning in the low frequency range, and hence its structural size may be reduced to half or less.

The invention has been described with reference to the figures in the above, but it is not limited to the embodiments. Various modifications to the concrete construction are within the scope of the claims as set forth below.

According to the present invention, which provides the stock liquor pressure pulsation absorbing apparatus comprising a by-pass pipe for extracting a portion of a stock liquor from a master pipe for supplying the stock liquor to a paper machine headbox, a control pump for returning a portion of the stock liquor so extracted into the by-pass pipe and a means for detecting a stock liquor pulsation pressure at a branch point, or on an upstream side thereof, of the by-pass pipe and master pipe for controlling the control pump, the amount of the stock liquor extracted via the by-pass pipe is regulated by the control pump corresponding to the pulsation pressure in the master pipe, and the pressure pulsation, especially in the low frequency range, can thereby be reduced greatly.

According to the present invention which provides the stock liquor pressure pulsation absorbing apparatus comprising a by-pass pipe for extracting a portion of a stock liquor from a master pipe for supplying the stock liquor to a paper machine headbox, a control valve for controlling an extraction amount of the stock liquor midway of the by-pass pipe and a means for detecting a stock liquor pulsation pressure at a branch point, or on an upstream side thereof, of the by-pass pipe and master pipe for controlling the control valve, the amount of the stock liquor extracted via the by-pass pipe is regulated by the opening of the control valve, which is controlled corresponding to the pulsation pressure in the master pipe, and the pressure pulsation especially in the low frequency range, can thereby be reduced greatly.

According to the present invention which provides the stock liquor pressure pulsation absorbing apparatus as set forth above in which a diaphragm type attenuator is provided on the upstream side or a downstream side of the branch point of the by-pass pipe and master pipe, the pressure pulsation in the low frequency range depends on the control by use of the by-pass pipe and the pressure pulsation in the higher frequency range is absorbed by the ordinary diaphragm type attenuator. Respective advantageous functions of the attenuators are thereby combined so as to attain a high efficiency of pressure pulsation in the entire range demanded in actual paper making machines through a high stability of control.

According to the present invention which provides a stock liquor pressure pulsation absorbing method comprising extracting a portion of a stock liquor continuously from a master pipe for supplying the stock liquor to a paper machine headbox and increasing or decreasing an amount of the stock liquor to be so extracted corresponding to a size of pulsation pressure in the master pipe, the pulsation of the stock liquor is absorbed accurately and precisely, and variation in the basis weight becomes small, whereby a stable supply of final products of high quality can be attained.

What is claimed is:

1. A stock liquor pressure pulsation absorbing apparatus, comprising:

a by-pass pipe having an upstream connection to a master pipe at a branch point for extracting a portion of stock liquor from the master pipe, and said by-pass pipe having a downstream connection to a by-pass tank, the master pipe being connected to a headbox for supplying paper stock;

a control pump for returning a portion of the extracted stock liquor from said by-pass tank to said by-pass pipe; and a means for detecting a stock liquor pulsation pressure in the master pipe at a point no further downstream than the branch point for controlling the control pump.

2. The stock liquor pressure pulsation absorbing apparatus of claim 1, and further comprising a diaphragm type attenuator along the master pipe.

3. The stock liquor pressure pulsation absorbing apparatus of claim 1, wherein the control pump is connected between the by-pass tank and the by-pass pipe at a point along the by-pass pipe upstream of the by-pass tank.

4. The stock liquor pressure pulsation absorbing apparatus of claim 1, wherein the means for detecting comprises a pressure gauge.

5. The stock liquor pressure pulsation absorbing apparatus of claim 4, wherein the pressure gauge is connected to a controller, the control pump being connected to an inverter connected to the controller.

6. The stock liquor pressure pulsation absorbing apparatus of claim 5, and further comprising a second pressure gauge along the master pipe downstream of the branch point, the second pressure gauge being connected to the controller.

7. A stock liquor pressure pulsation absorbing apparatus, comprising:

a by-pass pipe having an upstream connection to a master pipe at a branch point for extracting a portion of stock liquor from the master pipe, and said by-pass pipe having a downstream connection to a by-pass tank, the master pipe being connected to a headbox for supplying paper stock;

a control pump having an inlet for receiving a portion of the extracted stock liquor from the by-pass tank and an outlet connected with the by-pass pipe; and a pressure gauge located along the master pipe at a point no further downstream than the branch point for controlling the control pump.

8. The stock liquor pressure pulsation absorbing apparatus of claim 7, and further comprising a diaphragm type attenuator along the master pipe.

9. The stock liquor pressure pulsation absorbing apparatus of claim 7, wherein the control pump has the inlet thereof connected to the by-pass tank and the outlet thereof connected to the by-pass pipe at a point along the by-pass pipe upstream of the by-pass tank.

10. The stock liquor pressure pulsation absorbing apparatus of claim 7, wherein the pressure gauge is connected to a controller and the control pump is connected to an inverter connected to the controller.

11. The stock liquor pressure pulsation absorbing apparatus of claim 10, and further comprising a second pressure gauge along the master pipe downstream of the branch point, the second pressure gauge being connected to the controller.

* * * * *